US011525419B1

(12) United States Patent
Rexavier et al.

(10) Patent No.: US 11,525,419 B1
(45) Date of Patent: Dec. 13, 2022

(54) ENGINE POWER MODULE AND CYLINDER HEAD FOR SAME

(71) Applicant: Progress Rail Locomotive Inc., LaGrange, IL (US)

(72) Inventors: Raji Rexavier, Plainfield, IL (US); Joshua David Schueler, New Lenox, IL (US); Patricia A McWade, Willowbrook, IL (US)

(73) Assignee: Progress Rail Locomotive Inc., LaGrange, IL (US)

( * ) Notice: Subject to any disclaimer, the term of this patent is extended or adjusted under 35 U.S.C. 154(b) by 0 days.

(21) Appl. No.: 17/511,462

(22) Filed: Oct. 26, 2021

(51) Int. Cl.

| | |
|---|---|
| ***F02F 1/16*** | (2006.01) |
| ***F01P 3/02*** | (2006.01) |
| ***F02F 1/14*** | (2006.01) |
| ***F02F 1/40*** | (2006.01) |

(52) U.S. Cl.
CPC ..... *F02F 1/16* (2013.01); *F01P 3/02* (2013.01); *F02F 1/14* (2013.01); *F02F 1/40* (2013.01); *F01P 2003/027* (2013.01)

(58) Field of Classification Search
CPC ..... F02F 1/16; F02F 1/14; F02F 1/40; F01P 3/02; F01P 2003/027; F01P 3/12; F01P 3/14; F01P 3/16
See application file for complete search history.

(56) References Cited

U.S. PATENT DOCUMENTS

| | | | | |
|---|---|---|---|---|
| 3,377,996 | A * | 4/1968 | Anderson | F02F 1/40 123/41.31 |
| 2004/0139933 | A1* | 7/2004 | Obermayer | F01P 3/16 123/193.5 |
| 2015/0211408 | A1* | 7/2015 | Maier | F02F 1/16 123/41.82 R |
| 2016/0356201 | A1* | 12/2016 | Petutschnig | F02F 1/40 |
| 2017/0306831 | A1 | 10/2017 | Craft et al. | |

FOREIGN PATENT DOCUMENTS

| | | | |
|---|---|---|---|
| DE | 102008047185 | A1 | 4/2010 |
| EP | 3040547 | A1 | 7/2016 |

* cited by examiner

*Primary Examiner* — Hung Q Nguyen
(74) *Attorney, Agent, or Firm* — Brannon Sowers & Cracraft

(57) ABSTRACT

An engine power module includes a water jacket, a cylinder liner, and a cylinder head. The water jacket forms a coolant supply conduit arranged in a lower coolant annulus extending around the cylinder liner and an upper coolant annulus extending around the cylinder head. The cylinder head has formed therein an injector bore, and a plurality of drill holes convergent on the injector bore. A lower coolant cavity in the cylinder head forms a coolant flow path extending circumferentially around the injector bore between a cavity inlet opening fluidly connected to the coolant supply conduit, and a cavity connection opening fluidly connected to an upper coolant cavity. The arrangement provides flows of coolant through the drill holes to cool an injector sleeve, and separate coolant flows through the lower coolant cavity and upper coolant cavity.

19 Claims, 5 Drawing Sheets

ENGINE POWER MODULE AND CYLINDER HEAD FOR SAME

TECHNICAL FIELD

The present disclosure relates generally to an engine power module, and more particularly to a cylinder head for an engine power module having coolant cavity and passage structures for improved efficiency.

BACKGROUND

Internal combustion engines are widely used throughout the world in many applications including for vehicle propulsion, powering pumps, compressors, and other industrial equipment, as well as production of electrical power. A typical engine construction includes a cylinder block, commonly equipped with cylinder liners, and pistons movable within the cylinder liners to pressurize fluids including air and fuel in a combustion chamber. A cylinder head is attached to the cylinder block and supports engine valves, and a fuel injector in many applications. In compression-ignition engines, commonly operated on a diesel distillate fuel, fluids within each combustion chamber are compressed to an auto-ignition threshold. In spark-ignited engines, a typically less highly pressurized mixture is ignited by way of an electrical spark. Compression-ignition engines are typically although not exclusively built for heavier duty applications.

In one compression-ignition engine design individual power modules including a cylinder liner, a cylinder head section, and a liner jacket or water jacket are supported by an engine block, and arranged to couple to a common crankshaft. In certain medium-speed engines, a common design includes the cylinder head having a fire deck and a top deck physically separated around a fuel injector to provide a flow of engine coolant to a center of the cylinder head. A fuel injector sleeve is supported in the cylinder head and receives a fuel injector.

The fire deck of a cylinder head is typically subjected to high pressure loads. As a result the fire deck is generally designed to have considerable thickness. It is also common for there to be a substantial gradient in temperature through and over the fire deck. The combination of the relatively thick fire deck and temperature gradient can result in thermal stresses on the fire deck. Various strategies have been proposed over the years to mitigate these thermal stresses by improving cooling efficiency with the goal of ultimately increasing fatigue life of the cylinder head. Some strategies propose coolant flow with minimal flow restrictions. While such a strategy may work for lightly loaded applications where high conductivity and low strength material can be chosen, loading conditions of modern engines generally preclude such an approach.

Alternative approaches employ dedicated flow conduits for coolant that attempt to increase coolant flow velocity and thereby improve cooling. While such approaches can be effective they also tend to be quite costly given the generally small flow conduits in the cast cylinder head form. As-cast flow passages can also increase stress concentrations. Still other strategies attempt to employ high velocity cooling channels connecting among multiple valve seat annuli of the cylinder head. While these techniques can provide good cooling for certain areas, cooling efficiency on other hot regions of the cylinder head can be compromised. Moreover, forcing relatively large volumes of coolant flow through valve seat annuli can undesirably increase pressure drop and thereby parasitic losses on the engine. One example cylinder head design with various coolant flow features is known from U.S. Pat. No. 10,385,800, directed to a cylinder head assembly where a coolant passage is cross-drilled through a cylinder head to a cooling moat to provide a pumped flow of coolant into direct heat transference contact with components of an igniter or ignition assembly. The art provides ample opportunity for improvements and development of alternative strategies.

SUMMARY

In one aspect, an engine power module includes a water jacket, a cylinder liner received in the water jacket, and a cylinder head received in the water jacket in abutment against the cylinder liner. The water jacket forms, together with the cylinder liner and the cylinder head, a coolant supply conduit extending circumferentially around the cylinder liner and the cylinder head. The cylinder head has formed therein an injector bore defining a center axis, and a plurality of drill holes each fluidly connected to the coolant supply conduit and convergent on the injector bore. The cylinder head further has formed therein a lower coolant cavity forming a coolant flow path extending circumferentially around the injector bore between a cavity inlet opening fluidly connected to the coolant supply conduit, and a cavity connection opening fluidly connected to an upper coolant cavity.

In another aspect, a cylinder head for an engine includes a cylinder head casting having a cylinder head outer surface extending between a top deck and a fire deck having a lower fire deck surface, and having formed therein an injector bore extending through the cylinder head casting between the top deck and the fire deck and defining a center axis, a lower coolant cavity, and an upper coolant cavity, and further including gas exchange conduits extending through the upper coolant cavity and the lower coolant cavity to gas exchange openings formed in the fire deck. The cylinder head casting further has formed therein a plurality of drill holes each extending, between the lower fire deck surface and the lower coolant cavity, from a respective drill hole inlet formed in the cylinder head outer surface, to a respective drill hole outlet fluidly connected to the injector bore. The cylinder head casting further includes a mid deck, and the lower coolant cavity forms a coolant flow path extending circumferentially around the injector bore between a cavity inlet opening formed in the cylinder head outer surface, and a cavity connection opening fluidly connecting the lower coolant cavity to the upper coolant cavity and formed in the mid deck.

In still another aspect, a cylinder head for an internal combustion engine includes a cylinder head casting having a top deck, a mid deck, and a fire deck, and the cylinder head casting having formed therein an injector bore extending between the top deck and the fire deck and defining a center axis, a lower coolant cavity, and an upper coolant cavity. The cylinder head casting further has formed therein a plurality of drill holes formed in the fire deck and convergent upon the injector bore, a plurality of coolant feed openings formed in the mid deck and fluidly connecting the plurality of drill holes to the lower coolant cavity, and a cavity connection opening formed in the mid deck and fluidly connecting the lower coolant cavity to the upper coolant cavity.

DETAILED DESCRIPTION

Figure 1:
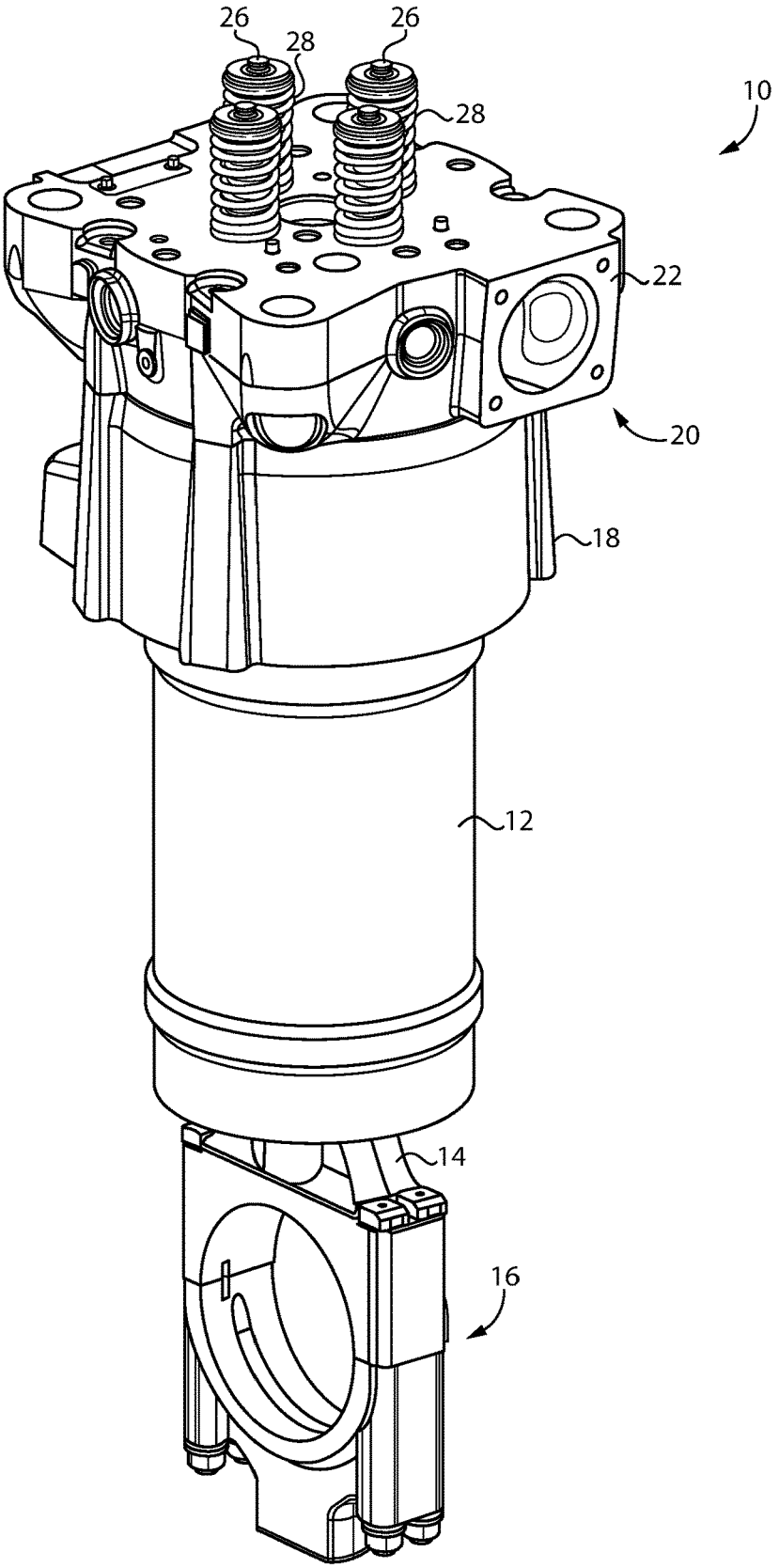
FIG. 1 is a diagrammatic view of an engine power module for an internal combustion engine, according to one embodiment.

Referring to FIG. 1, there is shown an engine power module 10 for an internal combustion engine. Power module 10 may include a cylinder liner 12 and a connecting rod 14, and cap 16 including crankshaft bearings, coupled with a piston (not shown) positioned within cylinder liner 12. Power module 10 may also include a cylinder head assembly 20 and a liner jacket or water jacket 18. Cylinder liner 12 is received in water jacket 18. Cylinder head assembly 20 includes a cylinder head 22 received in water jacket 18 in abutment against cylinder liner 12. Cylinder head assembly 22 is also equipped with engine valves 26 and valve return springs 28, as well as various internal structures to be further described herein.

Water jacket 18 may be attached to cylinder head 22 and extends around each of cylinder liner 12 and cylinder head 22 to provide a flow of a liquid engine coolant such as a mixture of water and conventional engine coolant around cylinder liner 12 and into cylinder head 22, as further discussed herein. A combustion chamber not visible in FIG. 1 is formed by cylinder head 22, cylinder liner 12, and the piston therein. In a practical implementation strategy power module 10 may be one of several power modules supported in a cylinder block, for instance, in a V-configuration. Power module 10 could also be arranged with other power modules in an inline configuration, or still another. Power module 10 may be used in an internal combustion engine in a wide variety of applications, including for vehicle propulsion, electric power generation, operation of a pump, compressor, or various others. In one embodiment, power module 10 is one of several power modules in an internal combustion engine system in a locomotive.

Figure 2:
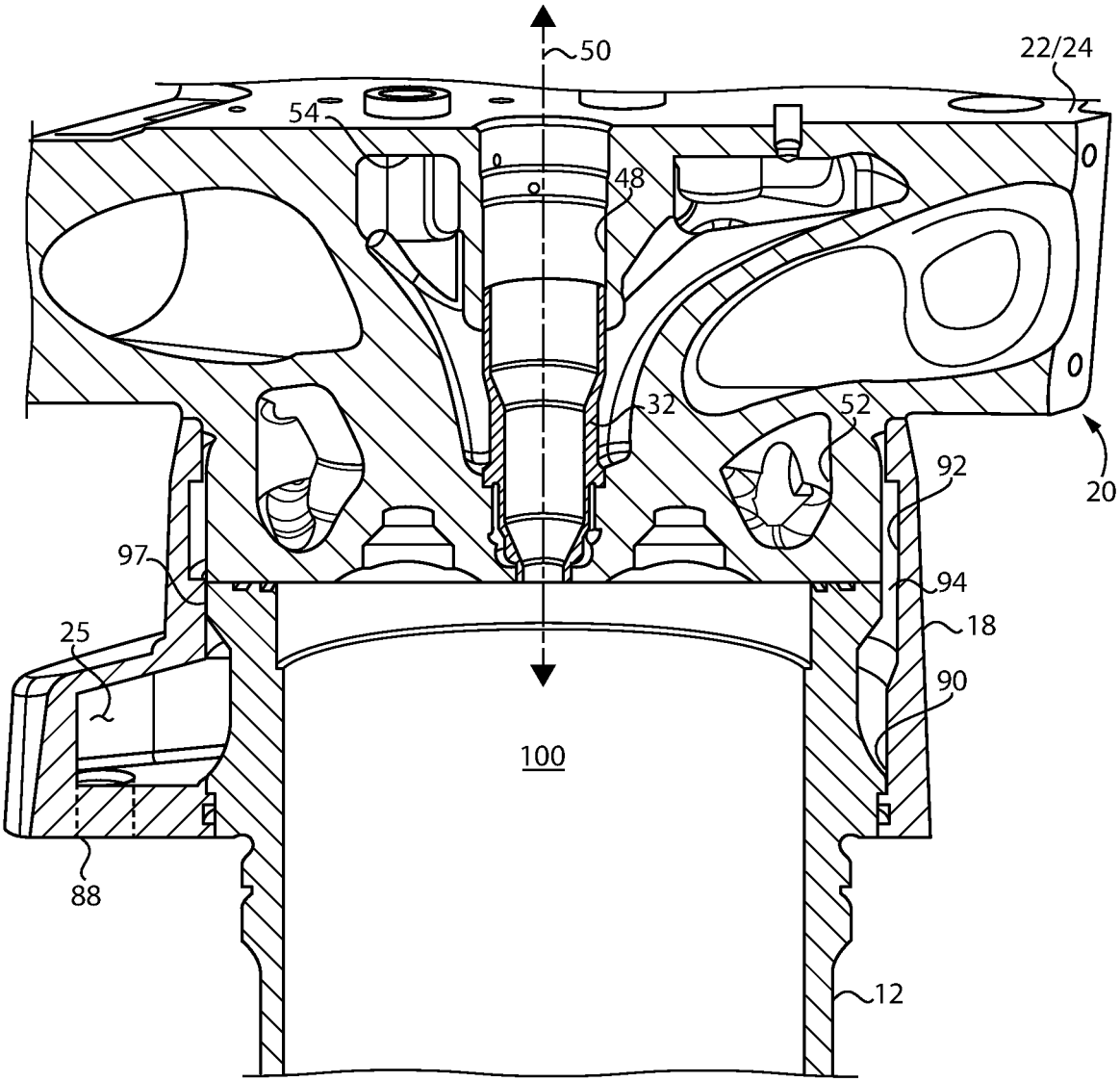
FIG. 2 is a sectioned view of portions of the engine power module of FIG. 1.

Referring also now to FIG. 2, there is shown a sectioned view through portions of power module 10. Cylinder head 22 can include a one-piece cylinder head casting 24 formed of a suitable casted metallic material such as iron, steel, aluminum, or various alloys. Cylinder head 22 and cylinder head casting 24 are terms used, at times, interchangeably herein. In FIG. 2 a combustion chamber 100 can be seen to be formed by cylinder liner 12 and cylinder head 22, as well as a piston that is not shown. Water jacket 18 forms, together with cylinder liner 12 and cylinder head 22, a coolant supply conduit 25 extending at least partially circumferentially around cylinder liner 12 and cylinder head 22. In the illustrated embodiment water jacket 18 forms a jacket inlet 88. Coolant supply conduit 25 forms a lower coolant annulus 90 fluidly connected to jacket inlet 88 and extending at least partially circumferentially around cylinder liner 12. Coolant supply conduit 25 also forms an upper coolant annulus 92 extending at least partially circumferentially around cylinder head 22.

Figure 3:
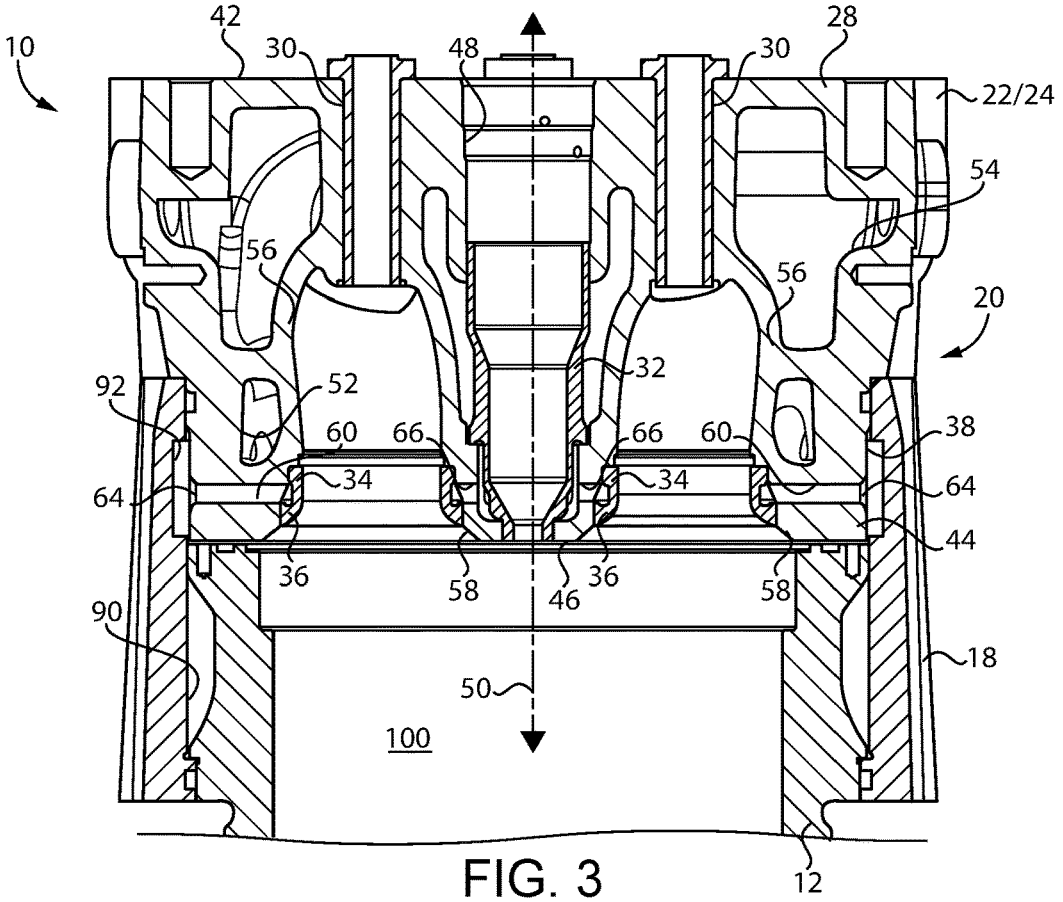
FIG. 3 is another sectioned view of portions of the engine power module of FIG. 1.
Figure 4:
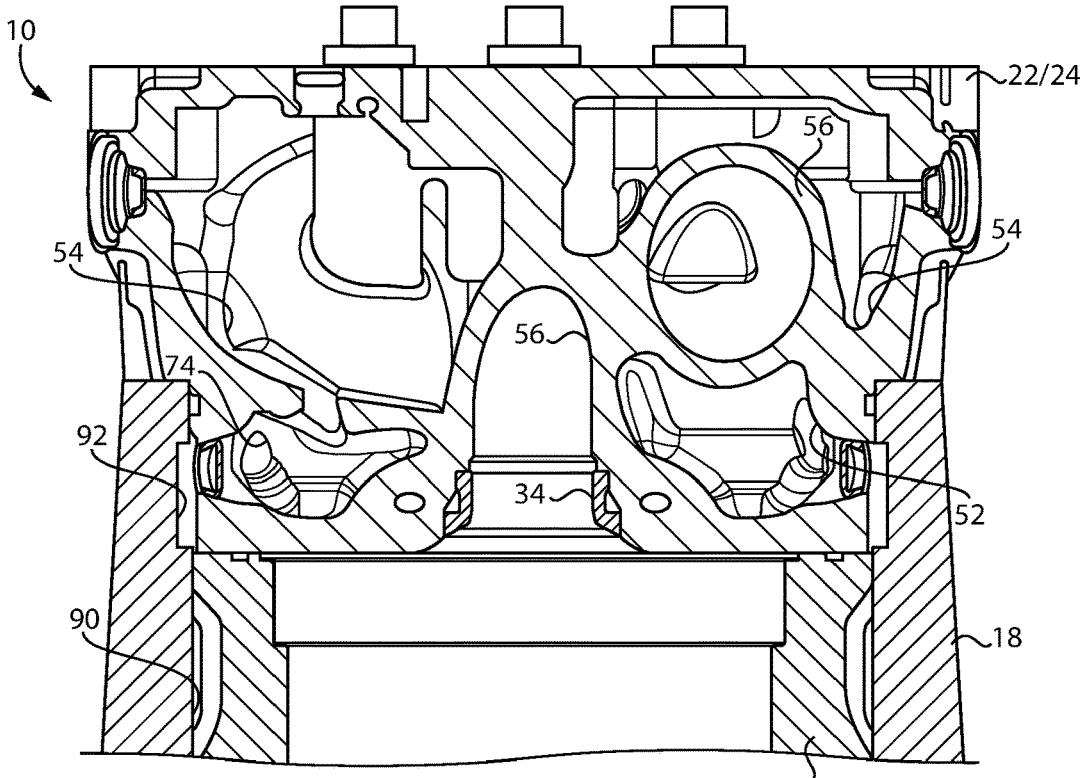
FIG. 4 is yet another sectioned view of portions of the engine power module of FIG. 1, rotated relative to FIG. 3.

Referring also now to FIGS. 3 and 4, cylinder head assembly 20 may include therein valve rod sleeves 30. Valve rod sleeves 30 may be structured to support engine valves for reciprocation in a generally conventional manner. In a practical implementation strategy a total of four engine valves can be provided, including two exhaust valves and two intake valves, although the present disclosure is not thereby limited. Cylinder head assembly 20 may also include an injector sleeve 32 installed in cylinder head 22 to support a fuel injector, also in a generally conventional manner. Valve seat inserts 34 are supported in cylinder head 22 and each forms a valve seat 36.

Cylinder head 22 and cylinder head casting 24 further includes a cylinder head outer surface 38 extending between a top deck 40 having a top deck surface 42 and a fire deck 44 having a lower fire deck surface 46 exposed to combustion chamber 100. A valve cover can be attached to top deck surface 40 when power module 10 is installed for service in an internal combustion engine system. Cylinder head 22 further has formed therein an injector bore 48 extending through cylinder head casting 24 between top deck 40 and fire deck 44. Injector bore 48 defines a center axis 50. Cylinder liner 12 may be centered on center axis 50.

Cylinder head 20 further has formed therein a lower coolant cavity 52, and an upper coolant cavity 54, and further includes gas exchange conduits 56 extending through upper coolant cavity 54 and lower coolant cavity 52 to gas exchange openings 58 formed in fire deck 44. The gas exchange openings 58 may fluidly connect to gas exchange conduits 56, with fluid communication between gas exchange conduits 56 and combustion chamber 100 controlled by way of engine valves opening and closing valve seats 36.

Figure 5:
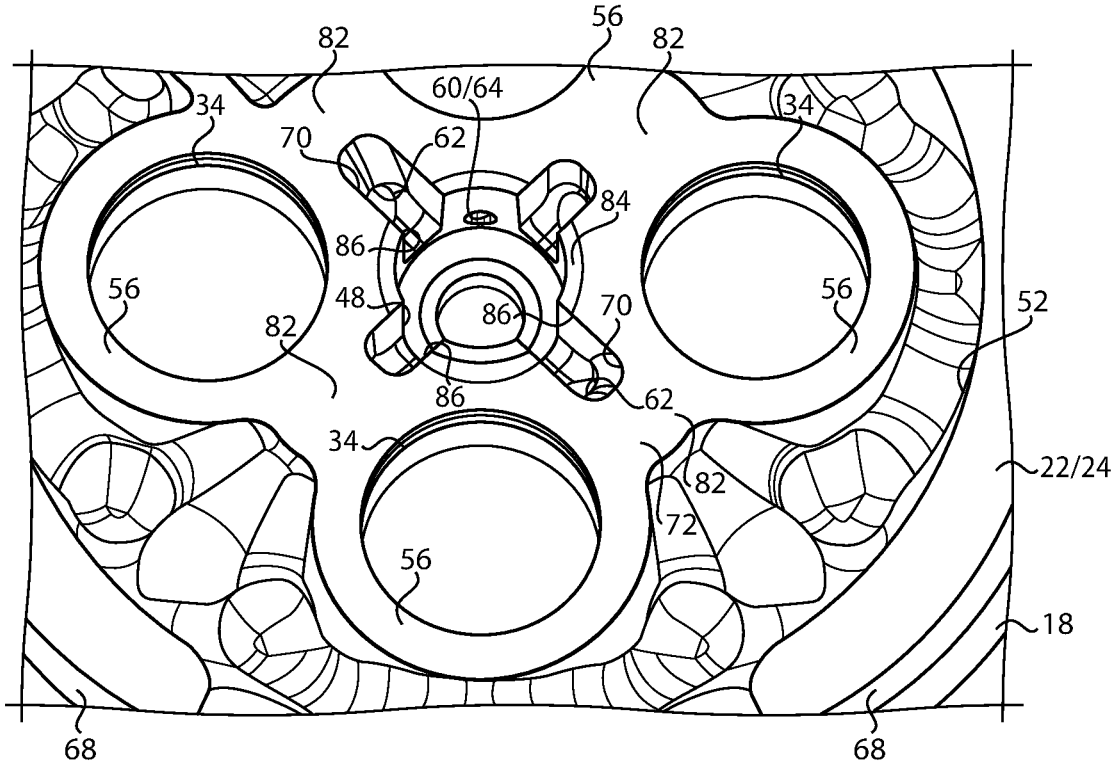
FIG. 5 is a sectioned view, in perspective, of a portion of a cylinder head casting, according to one embodiment.
Figure 6:
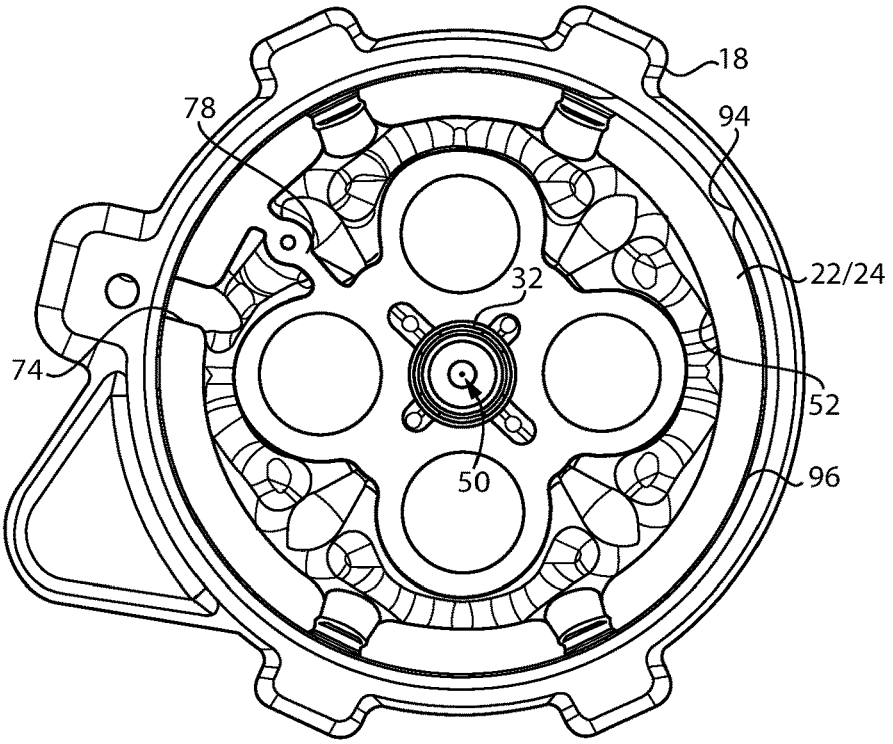
FIG. 6 is a sectioned view of a cylinder head casting and water jacket suitable for use in the engine power module of FIG. 1.
Figure 7:
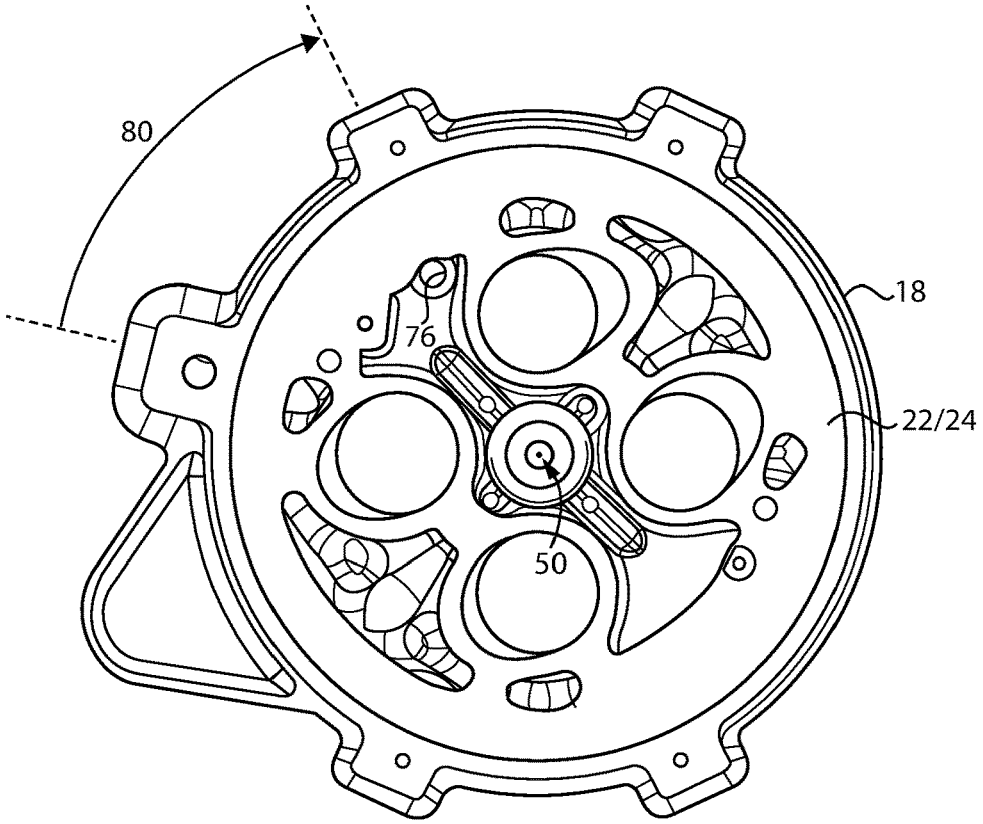
FIG. 7 is a sectioned view of a cylinder head casting and water jacket taken in a different section plane than FIG. 6.

Referring also now to FIGS. 5-7, cylinder head 20 further has formed therein a plurality of drill holes 60 and 62 each extending, at locations vertically between lower fire deck surface 46 and lower coolant cavity 52, from a respective drill hole inlet 64 and 68 formed in cylinder head outer surface 38 to a respective drill hole outlet 66 and 70 fluidly connected to injector bore 48. Cylinder head 22 further includes a mid deck 72. Lower coolant cavity 52 forms a coolant flow path extending circumferentially around injector bore 48, counter-clockwise in FIG. 5, between a cavity inlet opening 74 formed in cylinder head outer surface 38, and a cavity connection opening 76 fluidly connecting lower coolant cavity 52 to upper coolant cavity 54 and formed in mid deck 72. Cavity inlet opening 74 and cavity connection opening 76 may be casted in features, hence "as-cast," as may exposed surfaces of cylinder head 22 defining lower coolant cavity 52 and upper coolant cavity 54. In contrast, drill holes 60 and 62, and injector bore 48 are machined features formed, for instance, by so-called gun drilling.

With continued reference to the drawings generally, but focusing on FIG. 5, cylinder head 22 further includes a plurality of valve bridges 82 extending between adjacent ones of gas exchange conduits 56. The plurality of drill holes 60 and 62 can include a plurality of valve bridge drill holes 62 and a plurality of valve seat drill holes 60 in an alternating arrangement with the plurality of valve bridge drill holes 62. In FIG. 5 drill hole inlets 68 to valve bridge drill holes 62 can be seen. FIG. 3 illustrates drill hole inlets 64. It will thus be appreciated that a flow of coolant from coolant conduit 25 enters the respective drill hole inlets 64 and 68 at a location slightly above a fire deck plane defined by lower fire deck surface 46. Thus, drill hole inlets 64 and 68 can be arranged at coolant feed locations distributed circumferentially around center axis 48. Cavity inlet opening 74 may be arranged vertically between the coolant feed locations and mid deck 72, and thus vertically between the coolant feed locations and top deck 40.

Mid deck 72 may further include an upward facing mid deck surface 84 extending circumferentially and discontinuously around center axis 48. Some, but less than all, of the plurality of drill holes 60 and 62 directly fluidly connect to upper coolant cavity 54 including by way of a plurality of discontinuities 86 (coolant feed openings) in upward facing mid deck surface 84. Thus, an incoming flow of coolant can enter drill hole inlets 64 and 68 from upper coolant annulus 92. Coolant exiting drill hole outlets 70 can flow generally directly upward around injector sleeve 32 and into upper coolant cavity 54. Coolant exiting drill holes 60 is restricted from direct upward flow and instead passes circumferentially around injector sleeve 32 to join the flow paths upward to upper coolant cavity 54 provided by discontinuities 86 in upward facing mid deck surface 84. In the illustrated embodiment the respective drill hole outlets 70 of valve bridge drill holes 62 are in circumferential alignment with discontinuities 86, although the present disclosure is not thereby limited.

With continued reference to the drawings generally, but focusing on FIGS. 6 and 7, it will be recalled that lower coolant cavity 52 forms a coolant flow path extending circumferentially around injector bore 48. Cylinder head 22 may further include a separating wall 78 extending vertically between fire deck 44 and mid deck 72 within lower coolant cavity 52. Separating wall 78 may be arranged to direct coolant flow in the circumferential coolant flow path. Thus, with incoming coolant through cavity inlet opening 74 entering lower coolant cavity 52 separating wall 78 can assist in causing the coolant to flow generally circumferentially around injector bore 48 to the point at which the coolant reaches cavity connection opening 76 and can flow then upwardly into upper coolant cavity 54. An angle 80 formed between cavity inlet opening 74 and cavity connection opening 76, inclusive of separating wall 78, may be 45° or less, causing the coolant flow path through lower coolant cavity 52 to extend at least a majority, and typically almost entirely, around cylinder head 22. As can be seen from FIG. 6, a recess or clearance 96 may be formed peripherally between cylinder head 22 and water jacket 18. Referring back to FIG. 2, a leakage clearance 97 may be formed between cylinder liner 12 and water jacket 18 to enable some controlled leakage of coolant upwardly during service. A larger, coolant feed clearance 94 is formed between cylinder liner 12 and water jacket 18 opposite to jacket inlet 88 and fluidly connects lower coolant annulus 90 to upper coolant annulus 92.

INDUSTRIAL APPLICABILITY

When power module 10 is installed for service in an internal combustion engine, engine coolant may be pumped into jacket inlet 88 from a coolant tank or other coolant reservoir, typically after having passed through a radiator or other heat exchanger. Coolant entering water jacket 18 through jacket inlet 88 will generally pass in two directions circumferentially around cylinder liner 12 toward coolant feed clearance 94. As noted above, some leakage of coolant may desirably occur through clearance 97, which may extend entirely around water jacket 18 and can be formed at least in part by a recess in water jacket 18. Coolant from lower coolant annulus 90 may pass upward into upper coolant annulus 92, and begin to flow circumferentially around cylinder head 22. It will be recalled that some engine coolant enters drill holes 60 and 62, which are arranged in a circumferential distribution around cylinder head 22. Engine coolant passing through valve seat drill holes 60 can pass circumferentially around and in direct heat transference contact with valve seat inserts 34. After passing around valve seat inserts 34 the engine coolant from drill holes 60 can pass around injector sleeve 32 to join with coolant incoming to injector bore 48 through valve bridge drill holes 62. The combined flows of coolant through drill holes 60 and 62 makes its way up to upper coolant cavity 54. In parallel with the flow of coolant through drill holes 60 and 62 additional coolant enters cavity inlet opening 74 and lower coolant cavity 52 to flow circumferentially around injector bore 48.

It will thus be appreciated that the present disclosure can be thought of as providing three separate and parallel flows of coolant, with the first flow passing through valve bridges 82, the second flow passing around the individual valve seat inserts 34, and the third flow passing into lower coolant cavity 52. Drill holes 60 and 62 are understood to be convergent upon injector bore 48 to combine flows of coolant near a geometric center of cylinder head 22. The first two paths of coolant flow through drill holes 60 and 62, respectively, and cool injector sleeve 32 and a fuel injector received therein. The generally unidirectional flow in the flow path through lower coolant cavity 52 assists in keeping flow velocity relatively high through the "lower jacket region" of cylinder head 22 including lower coolant cavity 52 and fire deck 44. The three parallel flows combine together in the "upper jacket" region of cylinder head 22 including upper coolant cavity 52 and top deck 40. The combined flows are then routed outside of power module 10 and returned to other parts of the engine coolant system. By separating the flows into three parallel streams, individual volume through each path may be controlled with respect to the other by design of power module 10 to attain optimal cooling based on the particular requirements of cylinder head 22. Further, dividing the flow into three paths enables a total pressure drop through power module 10 to be minimized. The various flow conduits are formed relatively easily by standard machining operations and do not require costly or risky intricate features. Strategic placement of the various conduits at the interfaces of mating components, moreover, further reduces manufacturing complexity. Last, since the various of the cooling channels can be formed by machining operations, risk of stress concentrating features is also minimized.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. An engine power module comprising:

a water jacket;

a cylinder liner received in the water jacket;

a cylinder head received in the water jacket in abutment against the cylinder liner;

the water jacket forming, together with the cylinder liner and the cylinder head, a coolant supply conduit extending circumferentially around the cylinder liner and the cylinder head;

the cylinder head having formed therein an injector bore defining a center axis, and a plurality of drill holes each fluidly connected to the coolant supply conduit and convergent on the injector bore; and the cylinder head further having formed therein a lower coolant cavity forming a coolant flow path extending circumferentially around the injector bore between a cavity inlet opening fluidly connected to the coolant supply conduit, and a cavity connection opening fluidly connected to an upper coolant cavity.

2. The engine power module of claim 1 wherein the water jacket forms a jacket inlet, and the coolant supply conduit forms a lower coolant annulus fluidly connected to the jacket inlet and extending circumferentially around the cylinder liner, and an upper coolant annulus extending circumferentially around the cylinder head.

3. The engine power module of claim 2 wherein a coolant feed clearance is formed between the cylinder liner and the water jacket opposite to the jacket inlet and fluidly connects the lower coolant annulus to the upper coolant annulus.

4. The engine power module of claim 1 wherein the cylinder head further includes a plurality of engine valve seats in a fire deck and a plurality of valve bridges between adjacent ones of the plurality of engine valve seats, and wherein the plurality of drill holes includes a plurality of valve bridge drill holes and a plurality of valve seat drill holes.

5. The engine power module of claim 4 wherein the plurality of drill holes include respective drill hole inlets arranged at coolant feed locations distributed circumferentially around the center axis, and the cavity inlet opening is arranged vertically above the coolant feed locations.

6. The engine power module of claim 1 wherein the lower coolant cavity is fluidly separated from the injector bore.

7. The engine power module of claim 6 wherein the cylinder head further includes a mid deck surface, and further comprising an injector sleeve within the injector bore clamped in contact with the mid deck surface.

8. The engine power module of claim 7 wherein the mid deck surface extends circumferentially and discontinuously around the center axis, and wherein some of the plurality of drill holes directly fluidly connect to the upper coolant cavity by way of discontinuities in the mid deck surface.

9. The engine power module of claim 1 wherein the cylinder head further includes a separating wall within the lower coolant cavity arranged to direct coolant flow in the coolant flow path between the cavity inlet opening and the cavity connection opening.

10. The engine power module of claim 9 wherein an angle formed between the cavity inlet opening and the cavity connection opening, inclusive of the separating wall, is 45° or less.

11. A cylinder head for an engine comprising:

a cylinder head casting including a cylinder head outer surface extending between a top deck and a fire deck having a lower fire deck surface, and having formed therein an injector bore extending through the cylinder head casting between the top deck and the fire deck and defining a center axis, a lower coolant cavity, and an upper coolant cavity, and further including gas exchange conduits extending through the upper coolant cavity and the lower coolant cavity to gas exchange openings formed in the fire deck;

the cylinder head casting further having formed therein a plurality of drill holes each extending, between the lower fire deck surface and the lower coolant cavity, from a respective drill hole inlet formed in the cylinder head outer surface, to a respective drill hole outlet fluidly connected to the injector bore; and the cylinder head casting further including a mid deck, and the lower coolant cavity forming a coolant flow path extending circumferentially around the injector bore between a cavity inlet opening formed in the cylinder head outer surface, and a cavity connection opening fluidly connecting the lower coolant cavity to the upper coolant cavity and formed in the mid deck.

12. The cylinder head of claim 11 wherein the cylinder head casting further includes a separating wall within the lower coolant cavity arranged to direct coolant flow in the coolant flow path.

13. The cylinder head of claim 12 wherein an angle formed between the cavity inlet opening and the cavity connection opening, inclusive of the separating wall, is 45° or less.

14. The cylinder head of claim 11 wherein:

the cylinder head casting further includes a plurality of valve bridges extending between adjacent ones of the gas exchange conduits; and the plurality of drill holes includes a plurality of valve bridge drill holes and a plurality of valve seat drill holes in an alternating arrangement with the plurality of valve bridge drill holes.

15. The cylinder head of claim 14 wherein the respective drill hole inlets are arranged at coolant feed locations distributed circumferentially around the center axis, and the cavity inlet opening is arranged vertically between the coolant feed locations and the mid deck.

16. The cylinder head of claim 14 wherein the mid deck further includes an upward facing mid deck surface extending circumferentially and discontinuously around the center axis, and wherein some of the plurality of drill holes directly fluidly connect to the upper coolant cavity by way of a plurality of discontinuities in the upward facing mid deck surface.

17. The cylinder head of claim 16 wherein the respective drill hole outlets of the valve bridge drill holes are in circumferential alignment with the plurality of discontinuities.

18. A cylinder head for an internal combustion engine comprising:

a cylinder head casting including a top deck, a mid deck, and a fire deck, and the cylinder head casting having formed therein an injector bore extending between the top deck and the fire deck and defining a center axis, a lower coolant cavity, and an upper coolant cavity; and the cylinder head casting further having formed therein a plurality of drill holes in the fire deck and convergent upon the injector bore, a plurality of coolant feed openings formed in the mid deck and fluidly connecting the plurality of drill holes to the lower coolant cavity, and a cavity connection opening formed in the mid deck and fluidly connecting the lower coolant cavity to the upper coolant cavity, wherein the cylinder head casting further includes a separating wall extending between the fire deck and the mid deck within the lower coolant cavity and located angularly between the cavity connection opening and a cavity inlet opening formed in a cylinder head outer surface.

19. The cylinder head of claim 18 wherein:

the fire deck includes a lower fire deck surface;

the plurality of drill holes are located vertically between the lower coolant cavity and the lower fire deck surface; and the cavity inlet opening is located vertically between the plurality of drill holes and the mid deck.

* * * * *